US007318279B2

(12) United States Patent
Mitsuyoshi et al.

(10) Patent No.: US 7,318,279 B2
(45) Date of Patent: Jan. 15, 2008

(54) METHOD OF MANUFACTURING ANNULAR BODY

(75) Inventors: Hiroshi Mitsuyoshi, Kikuchi-gun (JP); Yasuo Masuda, Kikuchi-gun (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 480 days.

(21) Appl. No.: 10/511,494

(22) PCT Filed: Apr. 11, 2003

(86) PCT No.: PCT/JP03/04647

§ 371 (c)(1),
(2), (4) Date: Oct. 15, 2004

(87) PCT Pub. No.: WO03/086698

PCT Pub. Date: Oct. 23, 2003

(65) Prior Publication Data

US 2005/0178005 A1 Aug. 18, 2005

(30) Foreign Application Priority Data

Apr. 16, 2002 (JP) ..... 2002-113479

(51) Int. Cl.
*B21K 1/38* (2006.01)

(52) U.S. Cl. ..... 29/894.35

(58) Field of Classification Search ..... 29/894.35, 29/894.345, 894.351, 428, 505, 525.14, 894.354
See application file for complete search history.

(56) References Cited

U.S. PATENT DOCUMENTS

2004/0016121 A1* 1/2004 Merz ..... 29/888.1

FOREIGN PATENT DOCUMENTS

JP 03-275289 12/1991
JP 09-047887 2/1997

* cited by examiner

*Primary Examiner*—John C. Hong
(74) *Attorney, Agent, or Firm*—Rankin, Hill, Porter & Clark LLP

(57) ABSTRACT

A rolled steel plate 1 wound in a roll shape is unrolled and is cut in given dimensions to form a blank 2. In this case, a cut surface 2*a* is caused to incline at 1 to 3 degrees relative to the thickness direction of the blank 2, wherein the inclination direction of the cut surfaces 2*a*, 2*a* on each side is reversed. The blank 2 cut in this manner is roll-formed to cause the cut surfaces 2*a*, 2*a* to confront each other. Since the cut surfaces 2*a*, 2*a* on each side incline at 1 to 3 degrees in the opposite direction as described above, the cut surfaces 2*a*, 2*a* are caused to be parallel. Then, the confronting sections are laser-welded to form a cylindrical body 3.

2 Claims, 3 Drawing Sheets

FIG. 4
PRIOR ART
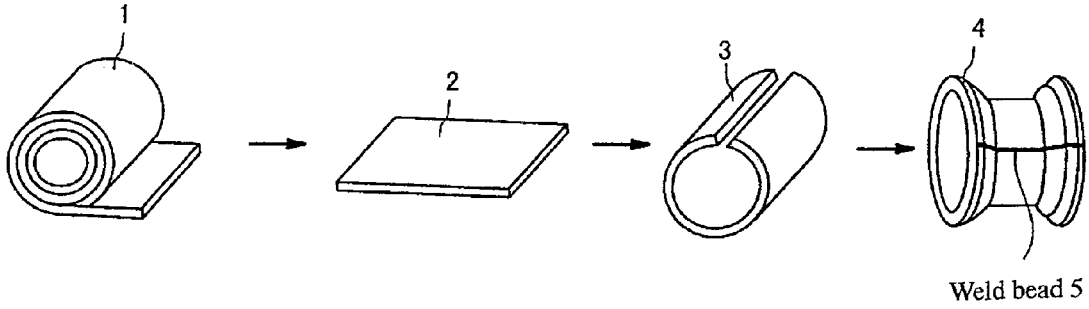
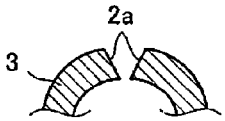
FIG. 5A
PRIOR ART
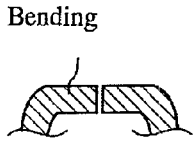
FIG. 5B
PRIOR ART
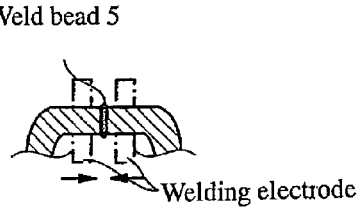
FIG. 5C
PRIOR ART

METHOD OF MANUFACTURING ANNULAR BODY

TECHNICAL FIELD

The present invention relates to a method for producing a circular body such as a rim which forms, for example, a tire wheel.

BACKGROUND ART

A general production process of a rim will be explained based on FIG. 4. A rolled steel plate 1 wound in a roll shape is cut in given dimensions to form a blank 2. The blank 2 is roll-formed to cause the cut surfaces on each side to confront each other. The confronting sections are flash butt welded to form a cylindrical body 3. Subsequently, the cylindrical body 3 is rim-formed to from a rim 4.

When the blank 2 is roll-formed to cause the cut surfaces on each side to confront, the cut surfaces 2*a* are open as shown in FIG. 5(*a*) and the surface to be inserted between electrodes is not flat. Accordingly, the cut surfaces 2*a*, 2*a* are not welded well by the flash butt welding. In the conventional production process, as shown in FIG. 5(*b*), bending is carried out to make the cut surfaces 2*a*, 2*a* parallel, wherein the surface to be inserted between the electrodes is made flat for flash butt welding. In the case of the flash butt welding, as shown in FIG. 5(*c*), an excess weld metal of a weld bead 5 is produced between the inside and outside of a welded section. Accordingly, the excess weld metal of the weld bead 5 is removed by after-treatment.

Japanese Unexamined Patent Publication No. HEI 3-275289 (1991) suggests laser welding as a means for welding.

By adopting the laser welding, the weld time is reduced and cutting of the bead of the excess weld metal after welding is not required. However, a bending process is still necessary to make the cut surface of the blank parallel. In the case where the bending process is not performed, fillers for filling in the gap are required during laser welding. This decreases the efficiency of rim production.

It is therefore an object of the present invention to provide an improved method for producing a circular body such as a rim forming a tire wheel.

DISCLOSURE OF THE INVENTION

To solve the above-mentioned problems, a production method for a circular body according to the present invention comprises the steps of, in the case of cutting a rolled steel plate wound in a roll shape, causing the cut surfaces on each side to incline relative to the thickness direction of the rolled steel plate so as to reverse the inclination direction of the cut surfaces on each side, and in the case of causing the cut surfaces on each side to confront each other, roll-forming a blank in the direction in which the cut surfaces are parallel, then laser-welding the cut surfaces.

In the case where a rim for a tire wheel is produced as the circular body, it is desirable that the angle of inclination of the cut surface be 1 to 3 degrees relative to the thickness direction.

BRIEF DESCRIPTION OF DRAWINGS

The above and other objects, features and advantages of the present invention will become more apparent from the following description when taken in conjunction with the accompanying drawings.

FIG. 4 is a view for explaining a conventional production process of a rim; and FIGS. 5(*a*) through (*c*) are enlarged views of a substantial part in the case where a cylindrical body of FIG. 4 is welded.

BEST MODE FOR CARRYING OUT THE INVENTION

Figure 1:
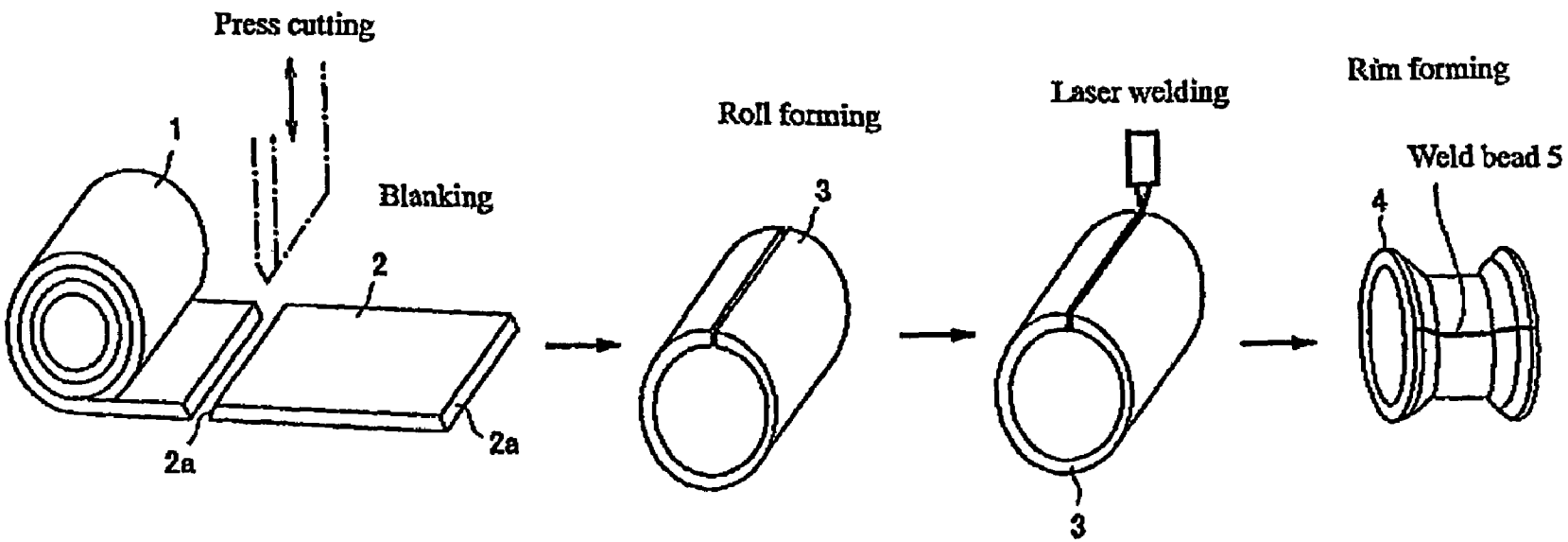
FIG. 1 is a view for explaining one embodiment of a production method for a circular body according to the present invention.
Figure 2:
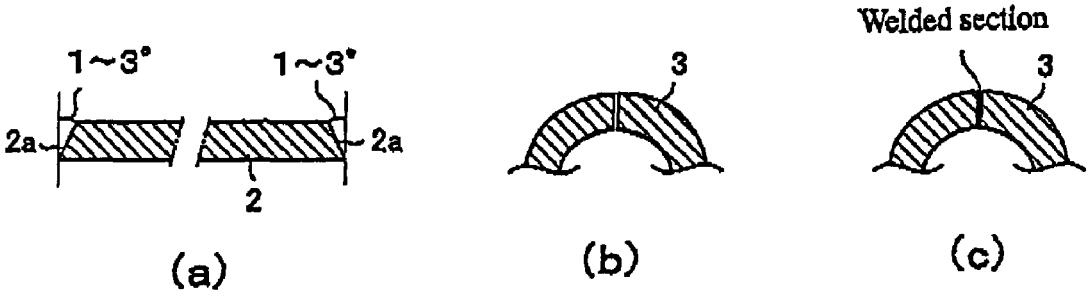
FIGS. 2(*a*) through (*c*) are enlarged views of a substantial part of FIG. 1.

Preferred embodiments of the present invention will now be described with reference to the accompanying drawings. FIG. 1 is a view for explaining a production method for a rim as a circular body according to the present invention and FIG. 2 is an enlarged view of a substantial part of FIG. 1, wherein the same member (section) as the conventional example has the same reference numeral.

First, a rolled steel plate 1 wound in a roll shape is unrolled and is cut in predetermined dimensions to form a blank 2. A means such as press cutting or laser cutting is used as a cutting method. In this case, as shown in FIG. 2(*a*), the cut surface 2*a* is caused to incline at 1 to 3 degrees relative to the thickness direction of the blank 2. Further, the inclination direction of the cut surfaces 2*a*, 2*a* on each side is reversed.

The blank 2 cut in this manner is roll-formed to cause the cut surfaces 2*a*, 2*a* on each side to confront each other. Since the cut surfaces 2*a*, 2*a* are caused to incline at 1 to 3 degrees on the opposite direction as described above, a gap is formed such that the cut surfaces 2*a*, 2*a* are caused to confront each in a parallel manner as shown in FIG. 2(*b*). Subsequently, the confronting sections where the gap is formed are laser-welded to obtain a cylindrical body 3.

The cylindrical body 3 is then rim-formed to from a rim 4. The rim-forming is performed in such a manner that forming dies, each having an external form copied from an intended rim shape, are provided on the inside and outside of the cylindrical body 3 to insert the cylindrical body 3 between the inside and outside forming dies. The cylindrical body 3 is drawn out or extended in the rim shape while rotating the forming dies.

Figure 3:
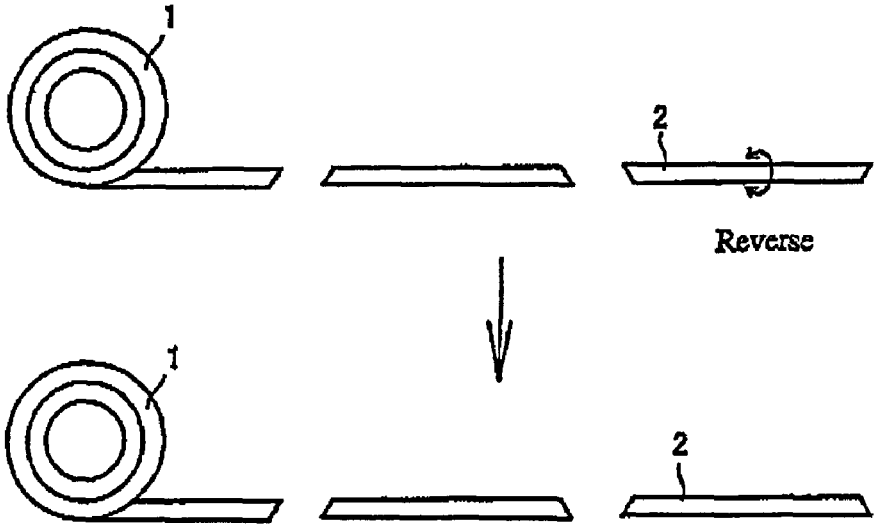
FIG. 3 is a view for explaining another embodiment.

FIG. 1 shows one embodiment by press cutting. FIG. 3 shows another embodiment in the case of laser cutting in which the blanks 2 cut after being unwound from the rolled steel plate are reversed alternately. In this manner, the cut surfaces are caused to be parallel in the case of roll forming and as a result, the material is not wasted.

The rim is shown as the circular body in the figure, but the present invention can also be applied to a circular body other than a rim.

INDUSTRIAL APPLICABILITY

As described above, according to the present invention, in the case where the circular body such as the rim is produced, the cut surfaces on each side of the blank to be laser-welded are caused to incline relative to the thickness direction of the blank. Accordingly, when the blank is rolled to form the cylindrical shape, the confronting cut surfaces are parallel without requiring a bending process and are welded in a short time without producing excess weld metal by laser welding.

The invention claimed is:

1. A production method for a circular body, comprising the steps of:

cutting a rolled steel plate to form a blank, wherein cut surfaces on each side of the blank are inclined relative to a thickness direction of the blank such that an inclination direction of the cut surfaces on each side is reversed;

roll-forming the blank in a direction to cause the cut surfaces on each side of the blank to be parallel to one another and to confront each other;

laser welding the confronting cut surfaces to one another to form a cylindrical body; and, forming the cylindrical body into a circular body of a predetermined shape.

2. The production method for a circular body according to claim 1, wherein the circular body is a rim and an angle of inclination of the cut surfaces is 1 to 3 degrees relative to the thickness direction.

* * * * *